United States Patent [19]

Schaul

[11] Patent Number: 4,541,337

[45] Date of Patent: Sep. 17, 1985

[54] PROCESS AND APPARATUS FOR CONTINUOUSLY TREATING A WEB ADAPTED TO PASS THROUGH A COMPUTER PRINTER

[75] Inventor: Jean-Paul Schaul, Neuhaeusgen, Luxembourg

[73] Assignee: Fraver S.A., Luxembourg, Luxembourg

[21] Appl. No.: 613,397

[22] Filed: May 22, 1984

[30] Foreign Application Priority Data

May 31, 1983 [BE] Belgium ..... 210890

[51] Int. Cl.[4] ..... B41F 5/06

[52] U.S. Cl. ..... 101/227; 101/181; 400/583.3

[58] Field of Search ..... 400/583.3, 578; 101/426, 233, 226, 225, 228, 227, 181

[56] References Cited

U.S. PATENT DOCUMENTS

| | | | |
|---|---|---|---|
| 3,191,526 | 6/1965 | Ross | 101/233 X |
| 3,464,349 | 9/1969 | Ritzerfeld | 400/583.3 X |
| 3,576,367 | 4/1971 | Sable | 101/226 X |
| 3,804,226 | 4/1974 | Ellis | 400/583.3 X |
| 4,108,067 | 8/1978 | Werner | 101/247 X |
| 4,328,749 | 5/1982 | Inouye et al. | 400/578 X |

FOREIGN PATENT DOCUMENTS

| | | | |
|---|---|---|---|
| 84698 | 8/1983 | European Pat. Off. | 400/583.3 |
| 60527 | 5/1977 | Japan | 400/583.3 |

*Primary Examiner*—Clifford D. Crowder
*Attorney, Agent, or Firm*—Young & Thompson

[57] ABSTRACT

A flexible deformable blank support such as a strip of paper, is fed and continuously treated or worked on in connection with its passage through a computer printer. The paper can be in the form of a roll or can be folded, and can pass through a finishing unit such as a perforator or a cutter. Plural autonomous printing units are provided, to perform different printing operations, in addition to or in lieu of the finishing units such as the perforators or cutters. The autonomous units are selectively controlled so as to adapt the printing and/or finishing as a function of the operation performed by the computer printer.

5 Claims, 5 Drawing Figures

PROCESS AND APPARATUS FOR CONTINUOUSLY TREATING A WEB ADAPTED TO PASS THROUGH A COMPUTER PRINTER

The present invention relates essentially to apparatus to feed and continuously treat or work on a flexible deformable blank support adapted to pass through a computer printer.

Up to the present, information centers always use documents pre-printed on a flexible deformable support such as a strip for example of paper, and the computer printer completes the pre-printed document with data contained in the computer memory.

The documents thus obtained may then be finished for example with an independent finishing unit which can provide for example cut-outs and/or perforations. These documents may then be delivered or sent to the destination or remain in the stack, that is to say in a bundle, to be used in this form in various departments or offices.

When the data processed by the computer and printed by means of the printer are different from each other and variable, according to the desired program, it is at present impossible to vary as desired and in a randomly programmable manner the basic impressions and generally in color as a function of the passage to the computer printer, and thus after the latter.

For example, if one has a stack or roll of paper pre-printed for example with invoice documents, all the documents of this stack or roll of documents will be the same, and it will not be possible to find there another document at a very different and irregular place, which can be for example: a forwarding letter, a covering letter, an advertising letter, a contract, and these in different colors while moreover the finishing operations, such as cut-outs, perforations, may be different in these documents and of a random or irregular nature. On the other hand, it has been attempted to eliminate the need to begin with a pre-printed roll or stack of paper by providing this printing by incorporating an autonomous printing unit before the computer printer.

However, although this solution permits starting with blank paper which may be used for different imprints, this solution still has the drawback of permitting handling only of the same type of document, for example invoices and it will not be possible to find there another document at a very different and irregular place, as previously indicated, such as a forwarding letter, a covering letter, an advertising letter, a contract, and these of different colors or even of different cuts and in a random or irregular manner.

Thus, it is necessary to provide a series of runs, for example first a series of invoices, then a series of covering letters, then advertising letters, etc. This manner of operation has the important drawback of requiring again the collection of the various printed documents to assemble them in the same envelope for transmission to their destination.

The present invention has for its object to solve or eliminate these drawbacks of the prior art by providing a new apparatus permitting advancing and continuously treating or working on a flexible and deformable support which is preferably blank, adapted to pass through a computer printer, providing individualized documents as desired, which is to say in a random or irregular manner.

Thus, the present invention permits solving the new technical problem set forth above, for the first time.

The solution according to the present invention therefore consists in apparatus to feed and continuously treat or work on a flexible deformable support which is preferably blank, such as a paper strip stored in a roll or folded, or the like, and adapted to pass through a computer printer, with the use of an autonomous unit comprising a printing and/or finishing unit, to provide a plurality of sheets or documents, characterized in that to provide the individualized documents as desired in a random or irregular manner, there is provided one or several autonomous printing units adapted to provide different impressions; and/or one or several autonomous finishing units, such as for perforating or cutting out, adapted to provide different finish shapes, such as perforations or cut-outs, and each of said autonomous units is selectively controlled so as to provide the impression and/or the finishing as a function of the task performed by the computer printer.

According to a preferred embodiment of the invention, the said selective control is programmed as a function of the programmed operation performed by the computer printer. According to a particular embodiment of this process, there is obtained the programming of the said selective control by the presence of marks on the flexible support which are preferably made by the computer printer and which are detected.

Advantageously, the printing units permit performing the printing of n different texts and/or of m different colors and/or of p different designs. On the other hand, the present invention also concerns an apparatus to feed and continuously treat or work on a flexible deformable support which is preferably blank, such as a strip for example of paper stored in a roll or folded or the like, and adapted to pass through a computer printer, with autonomous units comprising a printing unit and/or a unit for forming for example perforations, cut-outs, characterized in that it comprises one or several autonomous printing units capable of forming different impressions; and/or one or several autonomous finishing units, such as for perforation, cutting out, capable of performing different finishing operations, such as perforation or cutting out; and selective control means for each of said autonomous units adapted to control the printing and/or the finishing as a function of the operation performed by the computer printer.

According to an embodiment of the apparatus according to the invention, the latter comprises selective control means comprising a central memory containing a selective control program for each autonomous unit. According to another embodiment, the selective control means comprise detection means for marks on the flexible support which are preferably made by the computer printer.

Other objects, characteristics and advantages of the invention will become apparent from the description given with reference to the annexed drawings in which.

Figure 1:
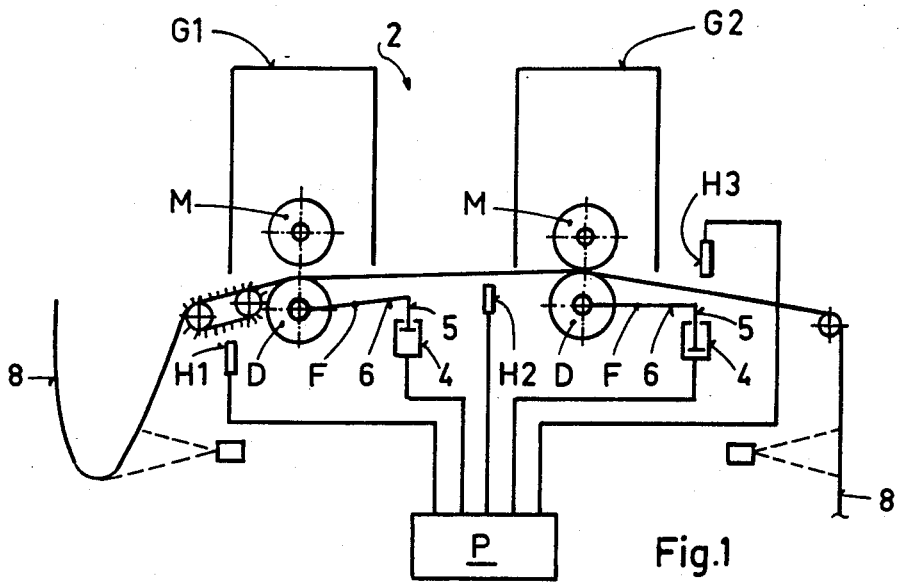
FIG. 1 shows schematically an apparatus according to the invention comprising for example two autonomous printing units adapted to form two different impressions.

Referring to FIG. 1, an apparatus according to the invention to feed and continuously treat or work on a flexible deformable support which may be blank or pre-printed for which there must be provided complementary or partial impressions or finishing operations, such as a strip for example of paper stored in a roll or folded, or the like, is characterized in that it comprises one or several autonomous printing units adapted to provide different impressions.

According to the example shown in FIG. 1, there is a printing unit which comprises two printing groups $G_1$ and $G_2$ permitting providing two different impressions. Naturally, the apparatus according to the invention may comprise x number of printing groups or x number of autonomous printing units, permitting providing x different impressions; the number of the printing units is therefore as desired and preferably permits providing the printing of n different texts and/or m different colors and/or p different designs. Likewise, the installation according to the invention may comprise in the same way one or several autonomous finishing units adapted to perform different finishing operations, such as perforation, cutting out.

With reference to FIG. 1, it will be seen that each unit or preferably group G of the unit 2 comprises a working cylinder M and a counter cylinder D mounted on arms pivotally articulated about point F and provided with jacks 4 whose piston 5 is connected to the arm 6 such that by actuating jack 4, between an operative position shown for group $G_2$, bearing against the counter cylinder M, and an inoperative position represented by the group $G_1$ in which the counter cylinder does not bear against the work cylinder M, the paper strip 8, preferably coming from the printer of the computer (not shown) which bears permanently against the counter cylinder D, may be selectively brought to bear against the work cylinder M for example of group $G_2$ of autonomous unit 2 by simple actuation of the jacks 4 of each group G of each unit by selective control means P which preferably comprise a central memory which according to a preferred embodiment is constituted by a microprocessor.

Figure 2:
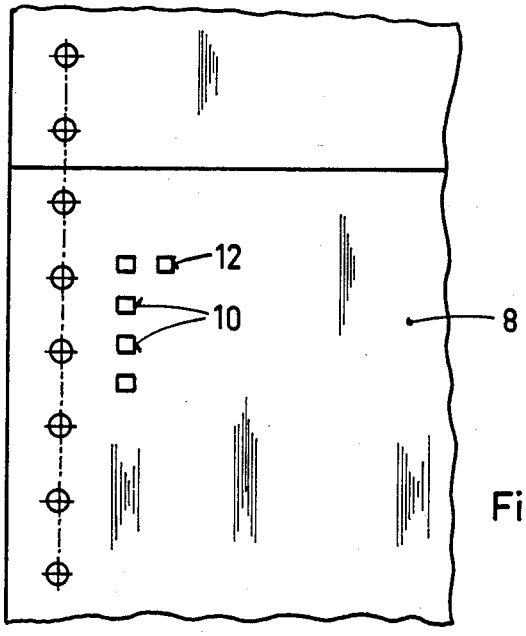
FIG. 2 shows a partial plan view showing the marks which can be made preferably by the computer printer.

The selective control means may also comprise advantageously detection means $H_1$, $H_2$ of mark(s) on the flexible support such as markings 10, 12, shown in FIG. 2, which are preferably formed by the computer printer. The markings 10 are for example adapted to control the desired printing and these markings 10 are therefore respectively read, transmitted to the microprocessor P which after analysis gives the order to jack 4 pivoting the cylinders of the counter cylinder D to effect a rotation in complete synchronization with the working cylinder M and predetermines the exact position in which the two cylinders must be located at the moment of contact. The same is true for the case of markings 12 which contain the necessary instructions for the carrying out of suitable finishing.

The marks on the flexible support 8 may be replaced by an appropriate program which may be entered either manually or by transfer onto a magnetic tape containing the necessary instructions for the microprocessor, thereby to make it operate in an irregular, cyclical or random manner.

This manner of operation may be effected either in a sequence integrated with a computer printer, or apart from the sequence of the computer printer. However, it is preferred that the apparatus according to the invention be inserted in the sequence integrated with the computer printer directly after passage through the computer printer.

Finally, there can be provided detection means $H_3$ verifying the proper synchronization of the work, which is to say the printing of a text, a color, a design; and/or finishings such as perforations, cut-outs, etc. . . . according to a third element which is the flexible support preferably constituted by a paper strip. It will thus be understood that this apparatus permits carrying out the process according to the above-described invention. The invention thus permits having at one's disposition plain paper sheets or even impressions or incompletely finished items, and to be able to individualize each document, according to its destination after its passage through the printer, which was totally impossible until now in any system utilized in all the continuous paper printers.

It is therefore possible according to the invention, with no risk of error, by application of the process and apparatus according to the invention, to proceed to the assembly or composition of a combination of different documents by their presentation, color, logo, designs, text, perforations, and this on the same paper strip and following each other in an order defined by the computer at the time of passage through its printer. Thus, the computer controls as a practical matter all the operations because either it provides markings on the flexible support thereby providing on the support the necessary information for the work operation subsequently performed by the selective control means according to the present invention of the various autonomous units, or else there is utilized a pre-planned program which may be transferred to magnetic tapes read by the microprocessor P, said program being adapted from the preliminary recognition of the program in the memory of the computer and which determines the order and the contents of the message which will be printed by the computer printer, to distinguish and individualize each of these documents. Thus, the invention is directly applicable to the field of office work to distinguish and completely individualize each document. No mixing is necessary because during the work operation performed according to the invention using the same functions, references, and the same electronics at least in principle, one can sever from each other the documents which are entirely different but are destined for the same person.

By contrast it was previously necessary to assemble several documents in different piles, after passage through computer printers, to assemble them and to place them in the same envelope, in an automatic or manual manner.

Figure 3:
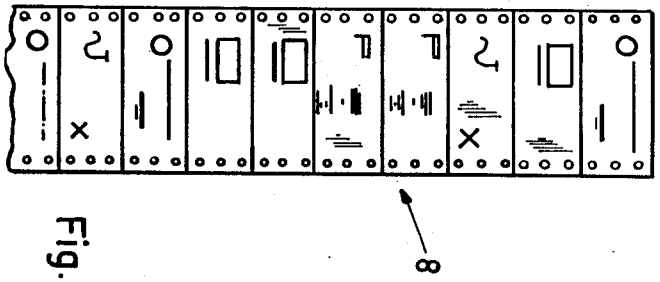
FIGS. 3 to 5 show various individualized documents obtained by the apparatus according to the invention.
Figure 4:
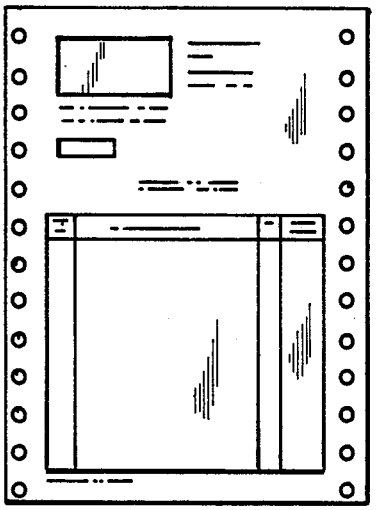
Figure 5:
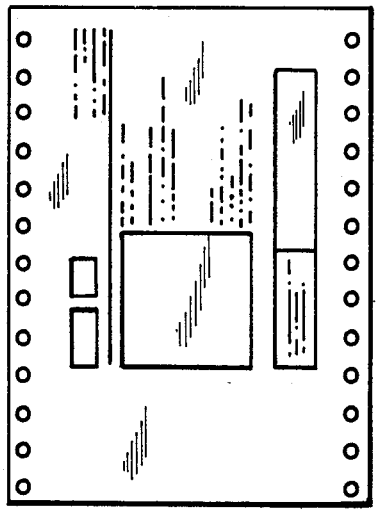

FIGS. 3 to 5 give examples of embodiments obtained by the apparatus and the method according to the invention.

Another embodiment is as follows:

Upon reception of a paper strip containing for example eleven documents of A4 size, cutting them one after the other, there will be obtained an assembly of an entire correspondence which is quite specific and completely individualized.

The first document will be for example a red-colored presentation letter, the second will be a blue-colored invitation but with preparation of one portion of the document which is red and detachable, and is to be returned to the sender duly completed. The third will be constituted by an invoice on green background with text in black, followed by four identical copies of which one among them contains a cut-out, etc. . . .

The following series may be comprised not by eleven documents but by four, for example with perforations, colored, with cut-outs which will no longer at all be in the same order nor on the same documents.

The following series may be comprised even by documents entirely different from the preceding series.

Naturally, according to the invention, all the documents may be disposed on a single strip of paper, one after the other in any order whatsoever of printing, the latter being effected in recto and/or verso, differently colored, with different texts, the order of the documents being infinitely variable as well as the finishing such as perforation or cutting out in the selected document in the series.

What is claimed is:

1. Apparatus for feeding and continuously printing on a flexible deformable strip so as to produce a printed strip having thereon a plurality of repeating series of impressions, each series of impressions comprising a plurality of successive but non-overlapping different impressions each of which, when subsequently severed from the others, will comprise a sheet different from at least one contiguous sheet in the series, comprising a computer printer, means for passing the strip through the computer printer so as to mark on the strip a series of marks having the spacing of the different impressions subsequently to be printed on the strip, a plurality of printing stations through which the strip passes sequentially, said stations being each adapted to print a different impression on the strip, means individual to each said station for reading the marks placed on the strip by the computer printer, each said individual reading means reading said marks to determine whether its associated said printing station is or is not to be actuated, and means responsive to the reading of said marks for individually actuating said printing stations with such timing as to print on the strip said series of different non-overlapping impressions, one said series after another.

2. Apparatus as claimed in claim 1, and means responsive to said reading for finishing the strip by perforating the same.

3. Apparatus as claimed in claim 1, and means responsive to said reading for finishing the strip by cutting out the same.

4. Apparatus as claimed in claim 1, in which the members of each said series of impressions vary from each other as to printed text.

5. Apparatus as claimed in claim 1, in which each said printing station comprises a work cylinder and a counter cylinder mounted on arms pivotally swung by the action of a jack between an operative position bearing against the work cylinder and an inoperative position in which the counter cylinder is spaced from the work cylinder, the jacks being actuated in response to said reading in such a way that the period in which each work cylinder and counter cylinder occupy their operative position is no more than the time required for the production of a single said impression.

* * * * *